United States Patent [19]

Cobble

[11] 4,187,788

[45] Feb. 12, 1980

[54] TUFTING MACHINE

[75] Inventor: James T. Cobble, Dalton, Ga.

[73] Assignee: B & J Machinery Company, Inc., Dalton, Ga.

[21] Appl. No.: 954,937

[22] Filed: Oct. 26, 1978

[51] Int. Cl.[2] ..... D05C 15/00

[52] U.S. Cl. ..... 112/79 R; 112/310; 112/321; 112/254; 112/255

[58] Field of Search ..... 112/79 R, 79 A, 221, 112/254, 255, 206, 213, 310, 321

[56] References Cited

U.S. PATENT DOCUMENTS

| | | | |
|---|---|---|---|
| 651,808 | 6/1900 | Noble . | |
| 754,934 | 3/1904 | Noble . | |
| 1,001,809 | 8/1911 | Brown . | |
| 1,041,654 | 10/1912 | Merritt | 112/221 |
| 1,956,453 | 4/1934 | Moench | 112/79 R |
| 2,111,394 | 3/1938 | Handschuh | 112/206 |
| 2,217,967 | 10/1940 | Phillips | 112/2 |
| 2,292,257 | 8/1942 | Zeier | 112/158 |
| 2,308,707 | 1/1943 | Myers | 112/158 |
| 2,390,288 | 12/1943 | Ballamy et al. | 112/221 |
| 2,577,430 | 12/1951 | Peterson et al. | 112/206 |
| 2,785,643 | 3/1957 | Mitchell | 112/79 R |
| 2,853,032 | 9/1958 | Odenweller | 112/79 A |
| 2,991,738 | 7/1961 | Zenner et al. | 112/79 A |
| 3,108,554 | 10/1963 | Payne et al. | 112/79 R |
| 3,331,344 | 7/1967 | Haugan | 112/213 |
| 3,352,265 | 11/1967 | Cobble et al. | 112/79 R |
| 3,387,578 | 6/1968 | McCutchen | 112/79 R |
| 3,460,494 | 8/1969 | Denrer | 112/11 |
| 3,626,878 | 12/1971 | Cobble | 112/79 R |
| 3,762,346 | 10/1973 | Cobble | 112/79 R |
| 3,919,952 | 11/1975 | Lund | 112/79 R |

*Primary Examiner*—Ronald Feldbaum

*Attorney, Agent, or Firm*—Bell, Seltzer, Park & Gibson

[57] ABSTRACT

A tufting machine wherein the needle bar is reciprocated by a number of like, mounting assemblies which are positioned along the length of the machine, with each assembly comprising a number of linkage arms which are pivotally interconnected to thereby minimize friction and power consumption. Also, the reciprocation of the needle bar, which is guided by the assemblies, results in a pause at the bottom of the needle movement to facilitate pick-up of the yarn loops by the loopers, and the needles have a component of movement in the direction of movement of the backing fabric at the bottom of their stroke, whereby the needles function to deposit the yarn loops on fixedly mounted loopers. The machine further includes a yarn tension control arrangement which is readily adjustable during operation of the machine.

24 Claims, 11 Drawing Figures

78
75
77
84
74
80
35
18
17
36
45
46
43
44
Y
68
37
66
8
42
65
41
27
28
32
24
22
50
F
58
55
33
51
57
52
21
20
54
61
60
62
56
59
25
30

75
77
78
74
84
82
35
69
18
17
80
81
71
72
36
37
91
68
88
66
41
65
27
28
90
89
32
22
87
24
58
33
F
55
57
52
21
20
54

TUFTING MACHINE

The present invention relates to an improved tufting machine for forming pile fabric or the like, and which is characterized by a non-complex structure, low power consumption, and simplified adjustment and maintenance.

Tufting machines of varied design have heretofore been employed which cyclically carry yarn through a backing fabric to form a plurality of loops, and which sever the loops to form a cut pile. Generally, such prior machines comprise a needle bar which mounts a plurality of needles and extends transversely across the machine, means for reciprocating the needle bar between raised and lowered positions whereby the needles cyclically penetrate the backing fabric, means for guiding a yarn to each needle, and a looper and knife mounted on individual oscillating bars such that the loops are successively deposited on the looper and then severed by the knife.

The conventional means for reciprocating the needle bar comprises a number of push rods which mount the needle bar and extend into the head casting of the machine and so as to be reciprocable along a straight line. Also, a rocker shaft extends horizontally through the head casting of the machine, and a linkage interconnects the rocker shaft and each push rod so that oscillation of the rocker shaft serves to reciprocate the push rods, and thus the needles, along a straight line which is perpendicular to the backing fabric. Each push rod is mounted for reciprocation by a sleeve bushing which is mounted in the head casting, and a quantity of oil is placed in the head casting to insure adequate lubrication of the bushings.

One problem associated with the above described conventional tufting machines resides in the fact that the required oil lubrication system for the push rod bushings tends to leak, resulting in the oil staining the tufted fabric and creating a fire hazard. Further, the sliding friction at the busings tends to increase the power requirement of the machine, and limits its speed of operation.

The required structure for mounting and reciprocating conventional loopers and knives is also a source of several persistent difficulties. In particular, the loopers must be accurately aligned and moved with respect to the needles so as to properly enter the yarn loops, and the mounting and reciprocating structure for the loopers and knives is necessarily relatively complex and heavy. Thus substantial power is required for their rapid movement, and in addition, the relative movement of the loopers and knives generates a great deal of friction which further increases the power consumption and results in the rapid wearing of these components.

It is accordingly an object of the present invention to provide a tufting machine which effectively overcomes the above noted deficiencies of the prior machines.

It is a more particular object of the present invention to provide a tufting machine which minimizes frictional resistance, thereby permitting a higher speed of operation and a reduced power requirement, and which is substantially oil free.

It is another object of the present invention to provide a tufting machine wherein the needles pause at the bottom of their reciprocation, thereby permitting the yarns to relax and facilitating the pick-up of the yarn loops by the loopers.

It is a further object of the present invention to provide a tufting machine wherein the needles have a component of movement in the direction of movement of the backing fabric, and toward the loopers, during the portion of each reciprocation, wherein the needles have penetrated the fabric, and whereby the needles function to deposit the yarn loops on fixedly mounted loopers. This arrangement not only simplifies the mounting of the loopers and knives, but also alleviates undue friction between the needles and backing fabric and which can cause deflection and improper tufting at higher speeds.

It is still another object of the present invention to provide a yarn tension control arrangement for a tufting machine of the described type, and which is readily adjustable even during operation of the machine.

These and other objects and advantages of the present invention are achieved in the embodiment of the invention illustrated herein by the provision of a tufting machine wherein the means for mounting the neelde bar and needles for reciprocation comprises a push rod arm having one end fixed to the needle bar and which extends therefrom in a direction generally perpendicular to the backing fabric, a first mounting arm having one end pivotally connected to the push rod arm and extending in a direction generally transverse therefrom and a second end pivotally connected to a first support member, a second mounting arm having one end pivotally connected to the push rod arm and extending in a direction generally transverse therefrom and a second end pivotally connected to a second support member, and means operatively connected to the push rod arm for cyclically reciprocating the same in a direction toward and away from the backing fabric and as controlled or guided by the pivotal movement of the first and second mounting arms.

Preferably, the means for cyclically reciprocating the push rod arm comprises a drive shaft, a crank arm fixed to the drive shaft, a connecting arm pivotally interconnected to the crank arm and one of either the push rod arm, first mounting arm, or second mounting arm. Means are provided for oscillating the drive shaft about its axis, whereby the oscillating movement of the drive shaft acts to reciprocate the push rod arm. Further, the drive shaft is preferably mounted closely adjacent to a plane extending perpendicularly from the backing fabric and including the needle bar, and the crank arm is disposed on the drive shaft so that the crank arm, connecting arm, and push rod arm are generally parallel when the needles have fully penetrated the backing fabric. This arrangement serves to result in a pause in the movement of the needles upon the same reaching their fully lowered position. Also, in the preferred embodiment, the first support member comprises a pivot shaft, and the second support member comprises a rocker shaft and a linkage pivotally interconnecting the rocker shaft and mounting arm, and means are provided for oscillating the rocker shaft such that the needles have a component of movement in a direction parallel to the direction of movement of the backing fabric at the bottom of their stroke, with the movement being sufficient to deposit the yarn loops on fixed loopers.

Some of the objects having been stated, other objects will appear as the description proceeds, when taken in connection with the accompanying drawings in which—

Figure 1:
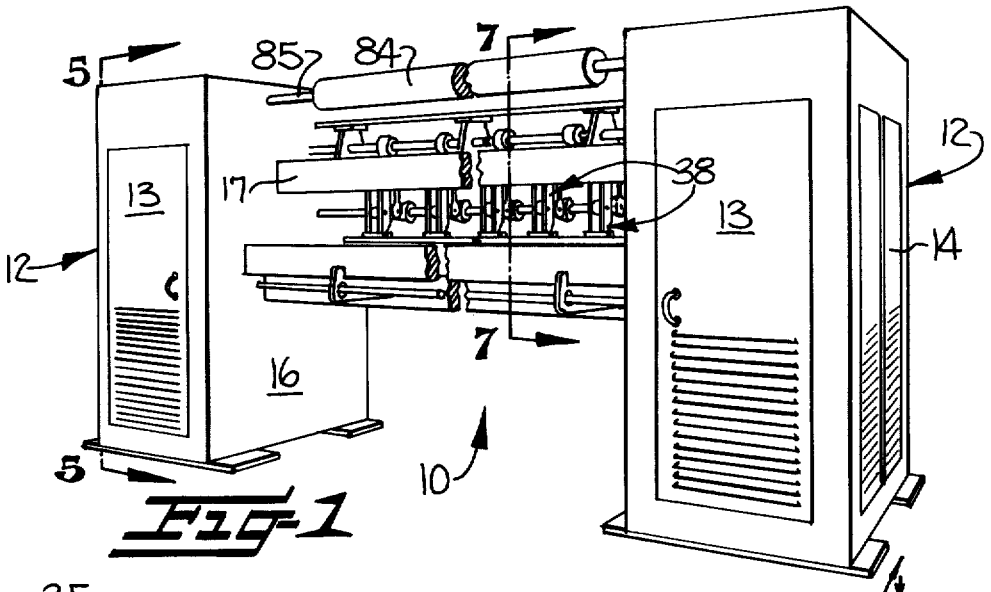
FIG. 1 is a perspective view of a tufting machine embodying the features of the present invention.
Figure 6A:
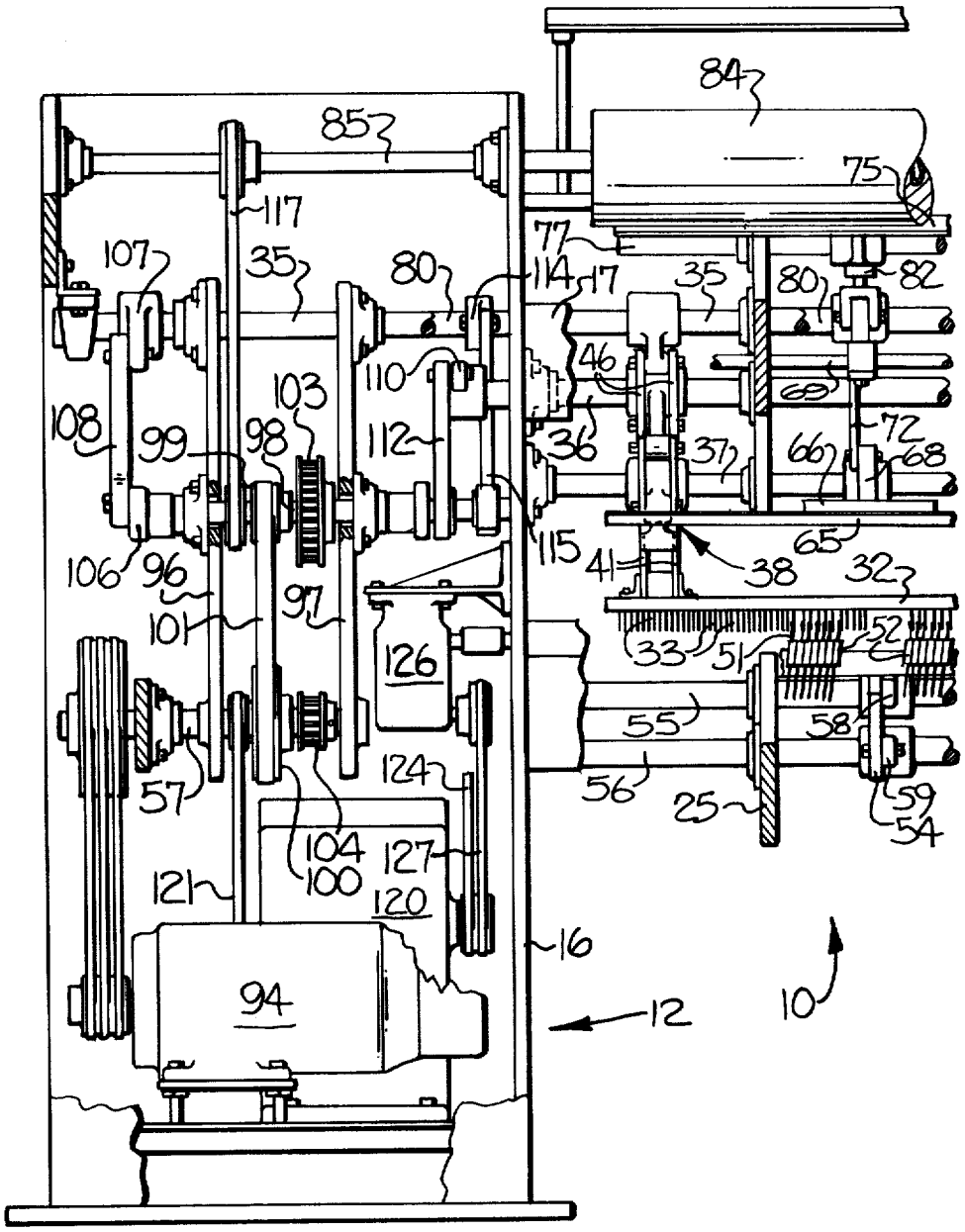
Figure 6B:
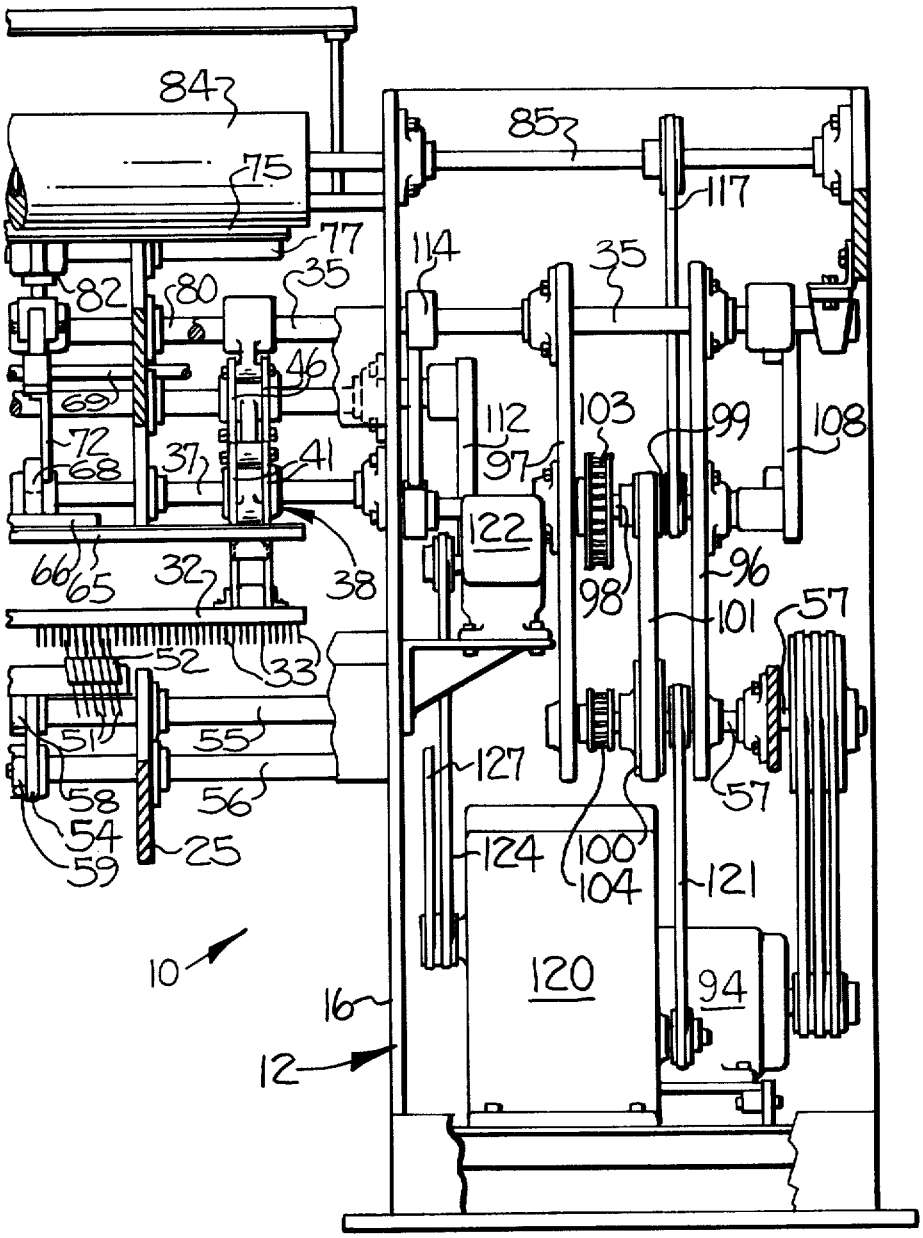
Figure 7:
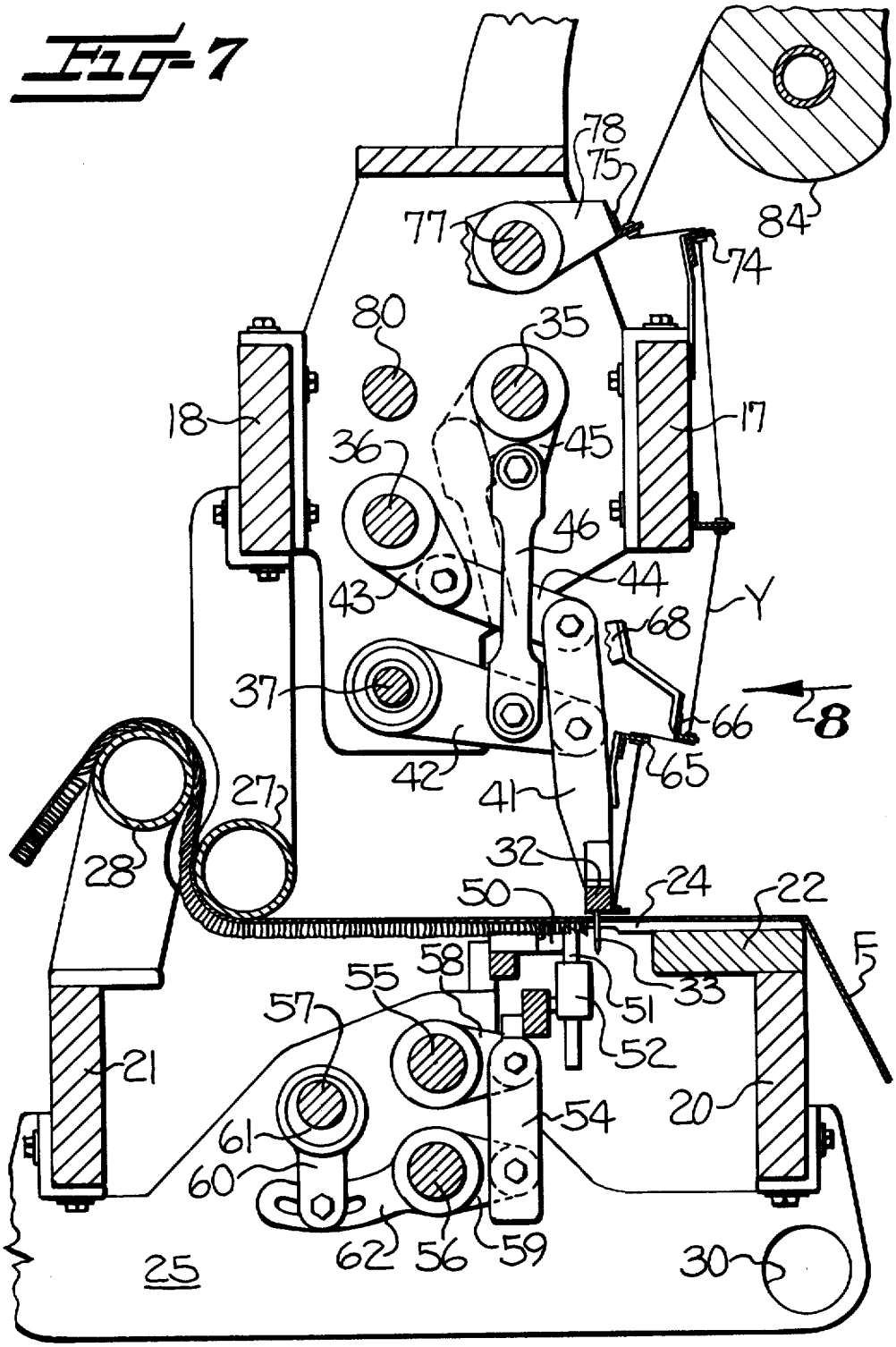
Figure 8:
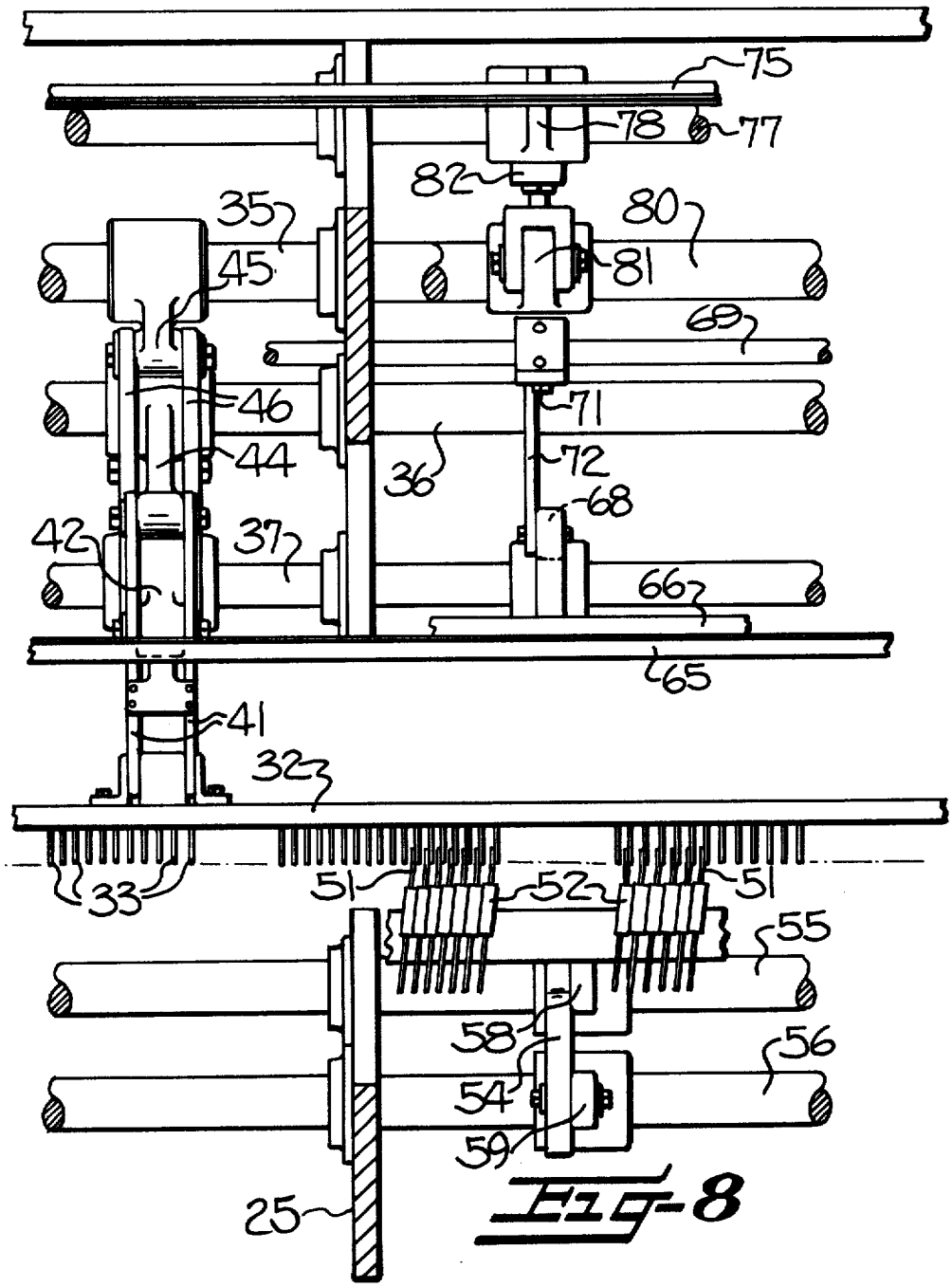

FIGS. 6A and 6B collectively represent a sectional front view of the machine;

FIG. 7 is a fragmentary sectional elevation view taken substantially along the line 7—7 of FIG. 1;

FIG. 8 is a fragmentary front elevation view of the machine; and

Figure 9:
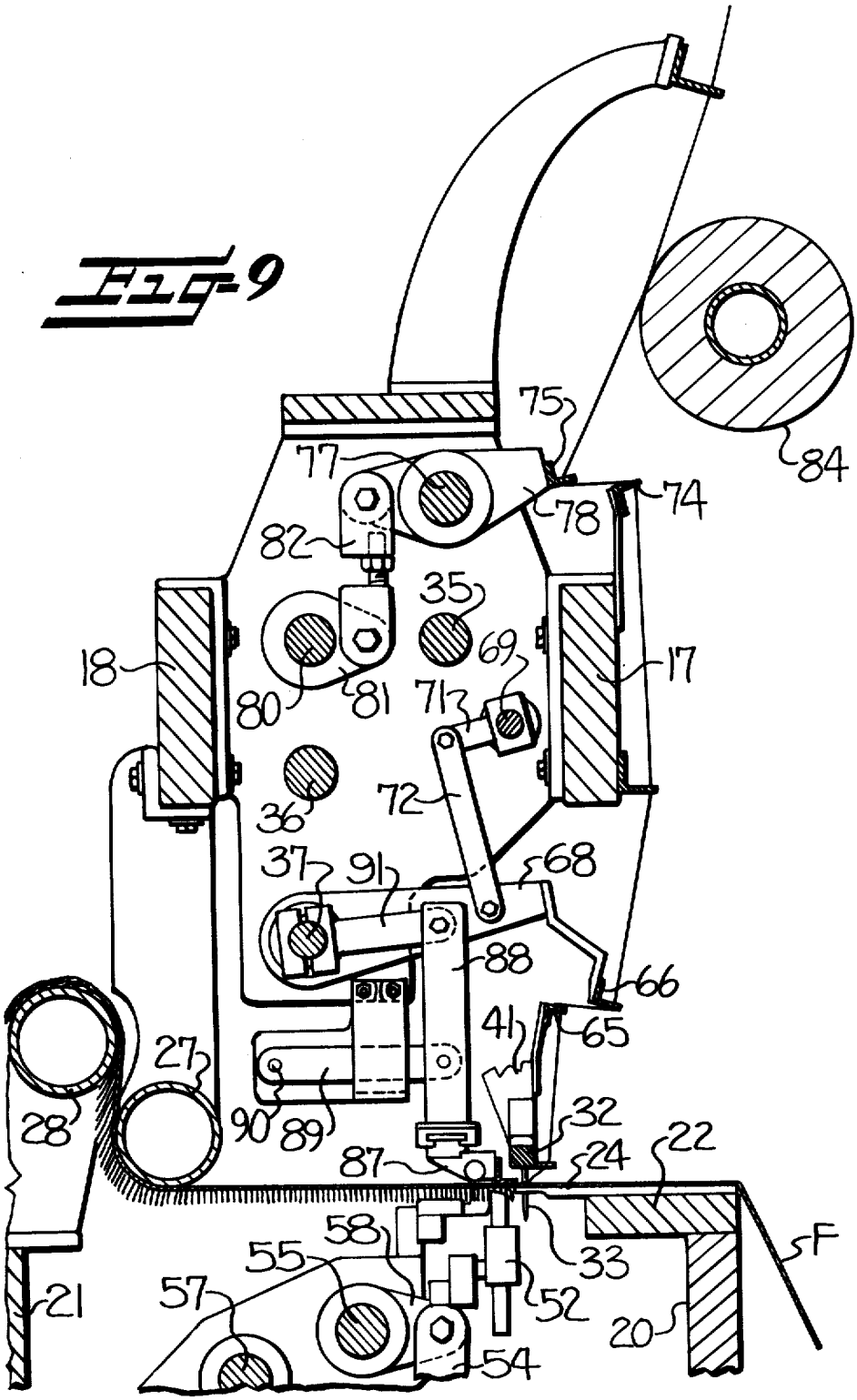

FIG. 9 is a view taken similar to FIG. 7, but illustrating the yarn tension control system of the machine.

Referring more specifically to the drawings, FIG. 1 illustrates generally at 10 a tufting machine which embodies the features of the present invention. More particularly, the machine includes a frame which comprises a pair of end supports 12, each of which are in the form of a box-like cabinet with front and side access doors 13, 14 respectively. Each end support includes an inwardly facing, vertically disposed support wall 16. Also, a pair of aligned head rails 17, 18 extend horizontally between the walls 16 of the end supports, and a pair of bed rails 20, 21 extend horizontally between the walls 16 and below the head rails. A bed plate 22 is fixed to the front bed rail 20 and a conventional needle plate 24 is mounted on the bed plate 22. Preferably, the bed plate is mounted to the rail 20 by a conventional adjustable interconnection (not shown) whereby the needle plate 24 may be raised and lowered to control pile height. A number of frame plates 25 (FIG. 7) are mounted between the two bed rails.

The machine 10 also includes means for feeding an elongate backing fabric F longitudinally along a predetermined path between the end supports 12. As best seen in FIG. 7, the backing fabric F is advanced across the needle plate 24 and horizontally through the machine by a pair of cooperating feed rolls 27, 28. The feed rolls are driven at a constant speed by an arrangement hereinafter described. A forwardly positioned additional feed roll (not shown) may if desired be mounted for rotation along the axis of the opening 30 in the frame plate 25.

Figure 2:
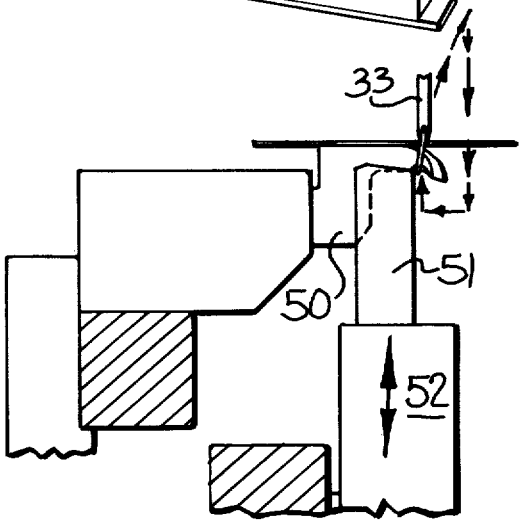
FIG. 2 is a fragmentary, partially sectioned elevation view of the looper and knife mechanism of the machine shown in FIG. 1.

An elongate needle bar 32 extends horizontally between the end supports, and mounts a longitudinal row of spaced tufting needles 33. The needle bar is mounted for reciprocation between a raised and lowered position and such that the needles cyclically penetrate the backing fabric F and are moved laterally in the direction of fabric movement while penetrating the fabric, note FIG. 2. This mounting arrangement includes a drive shaft 35 rotatably mounted between the end supports 12 and parallel to the needle bar 32, a rocker shaft 36 rotatably mounted between the end supports and disposed parallel to the drive shaft 35, and a pivot shaft 37 mounted between the end supports and disposed parallel to the drive shaft and rocker shaft. The shafts 35 and 36 extend through each support wall 16 and into the end supports 12, while the pivot shaft 37 terminates at and is rotatably mounted to the walls 16.

Figure 4:
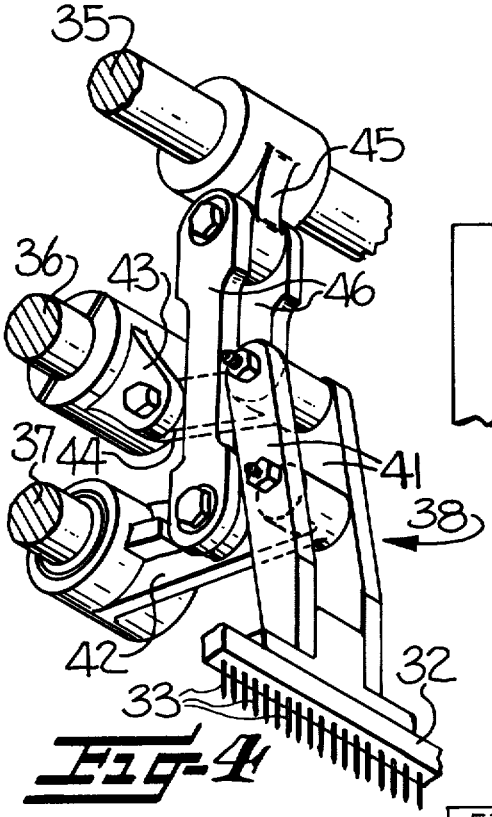
FIG. 4 is a fragmentary, perspective view of the assembly for mounting and cyclically reciprocating the needle bar in accordance with the present invention.

A plurality of mounting assemblies 38 as best seen in FIGS. 4 and 7 interconnect these three shafts to the needle bar. In particular, the mounting assemblies are spaced apart along the width of the machine between the end supports, and each comprises a push rod arm 41 having one end fixed to the needle bar 32 and extending therefrom in a direction generally perpendicular to the backing fabric F. The pivot shaft 37 is connected to the medial portion of the push rod arm 41 by a pivot arm 42, which is rotatably mounted on the shaft 37 and is pivotally connected to the arm 41. The rocker shaft 36 is connected to the upper free end of the push rod arm by a linkage which includes a first arm 43 fixed to the rocker shaft 36, and a second arm 44 having one end pivotally connected to the end of the push rod arm 41 and another end pivotally connected to the first linkage arm 43.

The drive shaft 35 is operatively connected to the needle bar 32 by an arrangement which includes a crank arm 45 fixed to the drive shaft, and a connecting arm 46 having its upper end pivotally connected to the crank arm 45, and its lower end pivotally connected to the pivot arm 42 at a medial point along its length. Means are also provided, and as hereinafter further described, for cyclically oscillating the drive shaft 35, causing the crank arm 45 and connecting arm 46 to move between a fully lowered position as seen in solid lines in FIG. 7, and a raised position as seen in dashed lines in FIG. 7. This results in the needles cyclically penetrating the backing fabric F. Also, means are provided for cyclically oscillating the rocker shaft 36, causing the push rod arm 41 to rotate about the pivotal connection between the pivot arm 42 and push rod arm 41, in a clockwise direction as seen in FIG. 7, and while the needles have penetrated the fabric, thereby resulting in the needles moving in the direction of fabric movement.

As best seen in FIG. 4, it will be noted that all of the interconnections between the various arms of each mounting assembly 38 comprise rotary bearings. Thus friction is minimized, and preferably, the bearings are of the ball type, to further minimize friction. In addition, it will be noted for example from FIG. 7, that the axis of the drive shaft 35 is disposed closely adjacent to a plane which extends perpendicularly from the backing fabric and includes the needle bar 32. Also, the above described oscillation of the drive shaft 35 results in the crank arm 45, connecting arm 46, and push rod arm 41 being generally parallel when the needles have fully penetrated the backing fabric F. This orientation in turn results in the needles pausing for a relatively long period of time at the bottom of each stroke, which causes the yarns to relax and thus facilitates the pick-up of the yarn loops by the loopers as hereinafter further described. It will also be noted that the rocker shaft 36 is disposed generally between the drive shaft 35 and needle bar 32, and the pivot shaft 37 is disposed generally between the rocker shaft 36 and needle bar.

The machine 10 further comprises pile forming means disposed on the side of the backing fabric F opposite the needle bar 32. More particularly, the pile forming means comprises a fixed looper 50 associated with each of the needles 33 and positioned so that the associated needle deposits the yarn loop thereupon while the needle is being moved laterally in the direction of fabric movement, note FIG. 2. Also, a knife 51 is operatively associated with each looper for severing the yarn deposited thereon.

In the illustrated embodiment, means are also provided for mounting and oscillating each knife 51 along a relatively straight, vertical path of travel. As best seen in FIG. 7, each knife 51 is supported by a knife block 52, which is in turn mounted at the upper end of a vertically directed knife arm 54. A pair of parallel support shafts 55, 56 and a jack shaft 57 extend between the end supports, in a generally triangular arrangement. A crank arm 58 is rotatably supported on the shaft 55, and is pivotally connected to the upper end of the knife arm 54, and a crank arm 59 is fixed to the shaft 56 and is pivotally connected to the lower end of the arm 54. The jack shaft 57 is operatively connected to the shaft 56 by a crank arm 60 which is rotatably connected to the jack shaft by an eccentric 61, and which is in turn adjustably and pivotally connected to a lever arm 62 which is fixed to the shaft 56. By this arrangement, rotation of the jack shaft 57 in the manner hereinafter further described, acts to oscillate the lower support shaft 56, and to reciprocate the knife bar 54 and each knife 51 along a straight, vertical path of travel.

The machine 10 further comprises means for advancing the yarns Y from a creel or the like along a path of travel to individual needles, and means positioned along the path of travel for selectively controlling the tension on each yarn during each reciprocation of the associated needle such that the yarn is tensioned during movement of the associated needle from its lowered to its raised position, to thereby tighten the tufting loops about the loopers. As best seen in FIG. 9, this tension controlling means includes a first yarn guide 65 which consists of a horizontally directed bar having a plurality of apertures along its length, with each aperture being adapted to receive an individual yarn end. The guide 65 is fixed to the push rod arms 41 of the several mounting assemblies 38, and extends transversely across the machine parallel to the needle bar 32, and thus is reciprocated therewith. A second yarn guide 66 of similar construction is mounted adjacent and parallel the first yarn guide 65. This second yarn guide 66 is mounted so as to permit the adjustable positioning thereof along a direction generally parallel to the direction of needle reciprocation, and comprises a lever arm 68 having one end rotatably mounted on the pivot shaft, and another end mounting the yarn guide 66. Means are also provided for adjustably rotating the lever arm 68 about the axis of the pivot shaft 37, and which comprises a control shaft 69 extending transversely across the machine and parallel to the pivot shaft, a handle (not shown) for manually rotating the control shaft, and linkage means in the form of first and second linkage arms 71, 72 interconnecting the control shaft and the lever arm. As will be apparent, rotation of the control shaft 69 causes the lever arm 68 and second yarn guide 66 to pivot about the axis of the pivot shaft 37, and such that it may be raised and lowered with respect to the first yarn guide 65 to thereby adjust the degree of yarn tension or jerk during upward reciprocation. Further, it will be apparent that this adjustment may be accomplished even while the machine is running.

The yarn tension control means of the machine 10 further comprises a third yarn guide 74 of a construction similar to that of the guides 65 and 66, and fixedly mounted to the front head rail 17 of the frame. A fourth yarn guide 75 of similar construction is also provided, and which is mounted to extend transversely across the machine and adjacent and parallel to the third guide 74. More particularly, the fourth guide 75 is mounted by an arrangement which includes an upper pivot shaft 77 extending transversely across the machine and parallel to and immediately above the drive shaft 35. Also, a transverse arm 78 is mounted on the upper pivot shaft and has an end thereof mounting the fourth guide 75. The upper shaft 77, and thus the fourth guide 75, are oscillated by an arrangement which includes a further pivot shaft 80 extending transversely across the machine and parallel to and laterally adjacent the drive shaft 35. A linkage, which comprises a crank arm 81, and a connecting arm 82 interconnects the further shaft 80 and the transverse arm 78. It will be noted that the connecting arm 82 includes a threaded portion and coooperating nut, whereby the length thereof may be adjusted, which in turn permits the position of the fourth yarn guide 75 to be adjusted with respect to the third guide 74.

The yarn feed system of the machine 10 further includes a single yarn feed roll 84 extending transversely across the machine and adapted to have the yarns Y encircle the same prior to passing through the above described guides and to the needles. The feed roll 84 is mounted on an axle 85 which extends into each end support 12, and is rotated at a constant speed as hereinafter further described, to advance the yarns Y from the conventional creel (not shown). In this regard, the shaft 80 is oscillated in a predetermined timed sequence by the means described below, and so that the reciprocation of the guide 75 acts to maintain a substantially constant tension of the yarns about the roll 84.

The machine 10 further includes a stripper bar 87 (note FIG. 9) which is designed to prevent the backing fabric F from lifting with the needles during their upward reciprocation. The stripper bar 87 is mounted for adjustment in the vertical direction by a four-bar linkage which is composed of a vertical arm 88 which mounts the bar 87, a first transverse arm 89 pivotally connected to the frame of the machine at 90, and a second transverse arm 91 fixed to the pivot shaft 37. If desired, a suitable handle (not shown) may be fixed to one end of the pivot shaft 37 to permit it to be readily rotated and so that the elevation of the stripper bar 87 may be readily adjusted.

The drive system for powering the various components of the machine as described above is housed in each of the end supports 12. In this regard, each end support 12 houses a separate power system, which is a duplicate and a mirror image of the power system in the other end support, such that both ends of the driven shafts are powered to thereby minimize torque loading. More particularly, each end support houses an electric motor 94, which is interconnected by pulleys and belts to the jack shaft 57. The jack shaft 57 extends across the full width of the machine, and as noted above, its rotation acts to reciprocate the knives 51. Also, it will be noted that the speed at which the knives 51 reciprocate need not be the same as the needle reciprocation. Thus the speed of the knives may be slowed for example to half the speed of the needles by suitably controlling the relative speed of the jack shaft 57, to thereby significantly reduce friction between the knives and loopers and the required power consumption.

A pair of like, mounting plates 96, 97 are rotatably mounted adjacent their lower ends to the jack shaft 57, and adjacent their upper ends to the drive shaft 35. Thus the two plates 96, 97 are fixedly disposed within the end support in a parallel, spaced apart arrangement. Also, the plates rotatably mount an intermediate drive shaft 98, and a first pair of pulleys 99, 100 and a drive belt 101 interconnect the jack shaft 57 and intermediate drive shaft 98, such that the intermediate shaft 98 continuously rotates at a predetemined speed with respect to the jack shaft 57. In this regard, there is also provided a second pari of cooperating pulleys 103, 104 which may be interconnected in place of the first pair to thereby permit the rélative speed between these two shafts to be readily changed.

Figures 5, 5A:
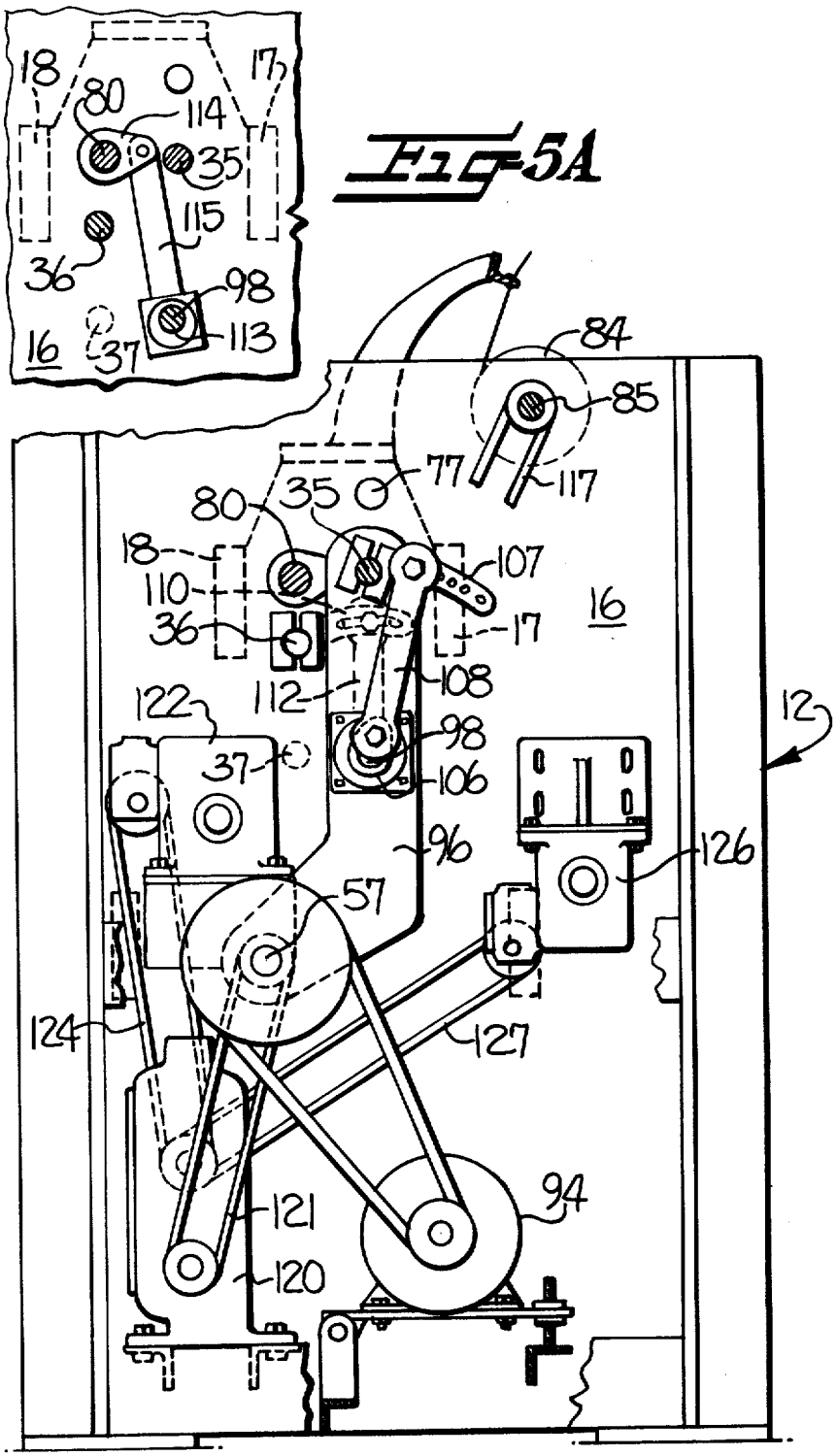
FIG. 5 is an elevation view of the interior of one end support of the machine and taken substantially along the line 5—5 of FIG. 1.
FIG. 5A is a fragmentary elevation view taken along a line parallel to that of FIG. 5 and illustrating a portion of the drive arrangement for the yarn tension control system of the machine.

As best seen in FIGS. 5 and 5A, the intermediate drive shaft 98 is interconnected with each of the shafts 35, 36 and 80, whereby the latter shafts are cyclically oscillated. Thus for example, to oscillate the drive shaft 35, there is provided an eccentric 106 fixed to the intermediate drive shaft 98, a crank arm 107 fixed to the shaft 35, and a connecting arm 108 pivotally connected to both the eccentric 106 and the crank arm 107. The point at which the connecting arm 108 is pivoted to the crank arm 107 may be adjusted to thereby control the extent of the oscillatory stroke of the shaft 35 and thus the needles 33, and the timing of the stroke may be adjusted by adjustably positioning the eccentric 106 on the shaft 98.

Similarly, the rocker shaft 36 is oscillated by means of an eccentric (not numbered), crank arm 110 and connecting arm 112. By this arrangement, the timing and extent of the lateral movement of the needles can be adjustably controlled. Also, it will be further noted that if desired, the oscillation of the rocker shaft 36 may be discontinued by disconnecting the crank arm 110 from the connecting arm 112, to thereby result in pure reciprocation of the needles and without lateral movement thereof. Finally, there is provided an eccentric 113, crank arm 114, and connecting arm 115 for oscillating the shaft 80 of the yarn tension control.

In order to rotate the yarn feed roll 84, there is provided a further pair of pulleys and drive belt 117 which interconnect the intermediate drive shaft 98 and the axle 85 of the roll. The feed rolls 27, 28 for the fabric F are driven by the motor 94, by an arrangement which includes a variable speed gear box 120, and which is interconnected to the jack shaft 57 by the pulleys and drive belt 121. The output of the gear box 120 is connected to the speed reducer 122, by suitable pulleys and drive belt 124, which is in turn operatively connected to the shafts of the feed rolls 27, 28. A second speed reducer 126 is provided for rotatably driving the above described (but non-illustrated) optional forward feed roller. This second speed reducer is operatively connected to the gear box 120 by pulleys and belt 127.

Figure 3:
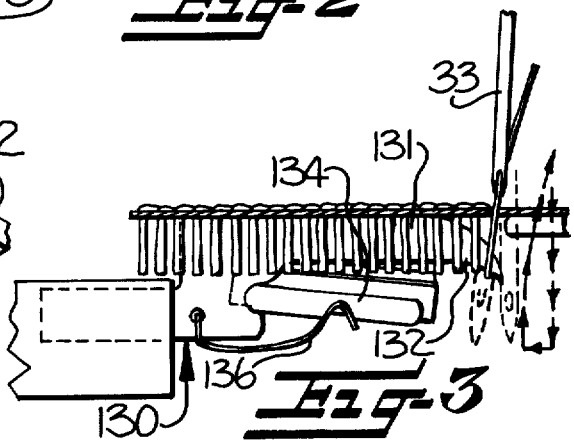
FIG. 3 is a view similar to FIG. 2 but illustrating an alternative embodiment for the looper and knife mechanism of the tufting machine.

FIG. 3 illustrates a modified looper and knife construction which is suitable for use with the present invention, and which avoids the need for a mechanism for reciprocating the knives. More particularly, this embodiment comprises a looper 130 mounted to the frame of the machine, and which includes a longitudinally extending bill 131 having a straight cutting edge 132 positioned on the side of the bill opposite the needles. The looper is formed at least in part by a pair of flat components which are parallel to each other and spaced apart to define a slot which extends transversely into at least a portion of the bill and communicates with the cutting edge 132. The knife is in the form of a blade 134 which is generally flat and has an elongate straight cutting edge on the upper side which extends into the slot in the looper and so as to form a forwardly facing scissors-like bight therebetween. A spring clip 136 has one end attached to the looper and an opposite end extending into a notch in the lower edge of the blade, whereby the blade is biased toward the cutting edge of the looper. Thus as the loops of yarn move along the bill by reason of the advance of the backing fabric F, they are brought into the bight between the blade and looper and are severed. A further more detailed description of this embodiment of the present invention may be obtained by reference to the applicant's copending application Ser. No. 954,936 filed concurrently herewith, and entitled "Looper and Knife for Cut Pile Tufting Machine".

In the drawings and specification, there has been set forth a preferred embodiment of the invention, and although specific terms are employed, they are used in a generic and descriptive sense only and not for purposes of limitation.

That which is claimed is:

1. A tufting machine for forming pile fabric or the like, and characterized by relative pivotal movement between its components as opposed to relative sliding movement, to thereby minimize frictional resistance and the need for lubricating oil, and comprising means for feeding an elongate backing fabric longitudinally along a predetermined path, an elongate needle bar extending in a direction transverse to the path of the backing fabric, and mounting a longitudinal row of spaced tufting needles which are adapted to carry yarns through the backing fabric, means for mounting said needle bar and needles for reciprocation in a direction transverse to the path of the backing material and such that the needles cyclically penetrate and withdraw from the backing fabric, said reciprocating means comprising (a) a push rod arm having one end fixed to said needle bar and extending therefrom in a direction generally perpendicular to the backing fabric, (b) a first mounting arm having one end pivotally connected to said push rod arm and extending in a direction generally transverse therefrom, and a second end pivotally connected to a first support member, (c) a support mounting arm having one end pivotally connected to said push rod arm and extending in a direction generally transverse therefrom, and a second end pivotally connected to a second support member, (d) means operatively connected to said push rod arm for cyclically reciprocating the same in a direction toward and away from said backing fabric and as controlled by the pivotal movement of said first and second mounting arms, and resulting in a corresponding reciprocation of said needle bar and needles, and looper mean disposed on the side of said backing fabric opposite said needle bar and operatively associated with each of said needles for forming rows of tufts in the moving backing fabric from the yarns carried by said needles.

2. The tufting machine as defined in claim 1 wherein said means for cyclically reciprocating said push rod arm comprises a drive shaft disposed in a direction generally parallel to said needle bar, a crank arm fixed to said drive shaft, a connecting arm pivotally interconnected to said crank arm and one of said push rod arm, first mounting arm, and second mounting arm, and means for oscillating said drive shaft about its axis, whereby the oscillating movement of said drive shaft acts to reciprocate said push rod arm.

3. The tufting machine as defined in claim 2 wherein the axis of said drive shaft is disposed closely adjacent to a plane extending perpendicularly from the backing fabric and including said needle bar, and said crank arm is disposed on said drive shaft so that said crank arm, connecting arm, and push rod arm are generally parallel when said needles have fully penetrated the backing fabric.

4. The tufting machine as defined in claim 1 wherein one of said first and second support members comprises a pivot shaft disposed generally parallel to said needle bar.

5. The tufting machine as defined in claim 4 wherein the other of said first and second support members comprises a rocker shaft disposed generally parallel to said pivot shaft and needle bar, a linkage arm fixed to said rocker shaft, means pivotally interconnecting said linkage arm and the associated mounting arm, and means for oscillating said rocker shaft about its axis and such that the needles have a component of movement in a direction parallel to the direction of movement of said backing fabric.

6. A tufting machine for forming pile fabric or the like, and characterized by relative pivotal movement between its components as opposed to relative sliding movement, to thereby minimize friction and the need for lubricating oil, and comprising a frame including a pair of spaced apart, vertically disposed, fixed end supports, means for feeding an elongate backing material longitudinally along a predetermined path between said end supports, an elongate needle bar mounting a longitudinal row of spaced tufting needles which are adapted to carry yarns through the backing fabric, means for mounting said needle bar between said end supports for reciprocation between raised and lowered positions and such that the needles cyclically penetrate the backing fabric and are moved laterally in the direction of fabric movement while penetrating the fabric, said mounting and reciprocation means comprising (a) a push rod arm having one end fixed to said needle bar and extending therefrom in a direction generally perpendicular to the backing fabric, (b) a drive shaft rotatably mounted between said end supports and parallel to said needle bar, (c) a rocker shaft rotatably mounted between said end supports and disposed parallel to said drive shaft, (d) a pivot shaft mounted between said end supports and disposed parallel to said drive shaft and said rocker shaft, (e) a pivot arm having one end pivotally connected to said push rod arm and another end pivotally connected to said pivot shaft, (f) means interconnecting said rocker shaft and push rod arm and comprising a first linkage arm fixed to said rocker shaft, and a second linkage arm having one end pivotally connected to said push rod arm at a point spaced from said pivot arm and another end pivotally connected to said first linkage arm, (g) means interconnecting one of said push rod arm, pivot arm, and second linkage arm to said drive shaft and comprising a crank arm fixed to said drive shaft, and a connecting arm having one end pivotally connected to said one arm and another end pivotally connected to said crank arm, and (h) means for cyclically oscillating said drive shaft and said rocker shaft in a predetermined sequence whereby the needles cyclically penetrate the backing fabric and are moved in the direction of fabric movement while penetrating the fabric, and pile forming means disposed on the side of said backing fabric opposite said needle bar and operatively associated with each of said needles for forming pile from the yarns carried by said needles.

7. The tufting machine as defined in claim 6 wherein the axis of said drive shaft is disposed closely adjacent to a plane extending perpendicularly from the backing fabric and including said needle bar, said rocker shaft is disposed generally between said drive shaft and needle bar, and said pivot shaft is disposed generally between said rocker shaft and needle bar.

8. The tufting machine as defined in claim 7 wherein said one end of said connecting arm is pivotally connected to said pivot arm.

9. The tufting machine as defined in claim 6 further comprising thread jerk means positioned along the yarn path of travel for selectively controlling the tension of the yarn during each reciprocation of the needles and such that the yarn is tensioned during movement of the needles from said lowered to said raised position to thereby tighten the yarn about said pile forming means.

10. The tufting machine as defined in claim 9 wherein said thread jerk means comprises a first yarn guide fixed to said push rod arm, a second yarn guide, means for mounting said second yarn guide to the machine and comprising a lever arm having one end rotatably mounted on said pivot shaft and another end mounting said second yarn guide, and means for adjustably rotating said lever arm about the axis of said pivot shaft.

11. The tufting machine as defined in claim 6 wherein said means for cyclically oscillating said drive shaft and said rocker shaft comprises a main power shaft disposed within each of said end supports, separate power means disposed within each of said end supports for rotating the associated main power shaft, and means operatively interconnecting each of the main power shafts to the adjacent ends of the drive shaft rocker shaft, whereby both ends of the drive shaft and rocker shaft are driven.

12. The tufting machine as defined in claim 6 wherein said pile forming means comprises a fixed looper operatively associated with each of said needles and positioned so that the associated needle deposits the yarn thereupon while being moved laterally in the direction of fabric movement.

13. The tufting machine as defined in claim 12 wherein said pile forming means further comprises knife means operatively associated with each looper for severing the yarn deposited thereon.

14. The tufting machine as defined in claim 13 wherein said knife means comprises a knife blade, and means for oscillating said knife blade along a relatively straight path of travel.

15. In a tufting machine for forming a pile fabric including a plurality of tufting needles extending transversely across the machine and mounted to a needle bar push rod for reciprocation between a raised position and a lowered position, power means for reciprocating said push rod and needles between said raised and lowered positions, means for guiding a yarn along a path of travel to each needle, and looper means operatively associated with each needle for forming successive tufting loops from the yarns, the combination therewith of means positioned along said path of travel for selectively controlling the tension on each yarn during each reciprocation of the associated needle such that the yarn is tensioned during movement of the associated needle from its lowered to its raised position to thereby tighten the tufting loops about said looper means, said tension controlling means comprising a first yarn guide fixed to said needle bar push rod so as to be reciprocated therewith and extending transversely across the machine, a second yarn guide, means for mounting said second yarn guide to extend transversely across said machine adjacent and parallel to said first yarn guide and so as to permit the adjustable positioning thereof along a direction generally parallel to the direction of needle reciprocation, said mounting means comprises a first pivot shaft extending transversely across the machine and generally parallel to said first and second yarn guides, a lever arm having one end mounted on said first pivot shaft and another end mounting said second yarn guide, and means for adjustably rotating said lever arm about the axis of said first pivot shaft, whereby reciprocation of said first yarn guide with respect to said second yarn guide acts to alternately lengthen and shorten the yarn path of travel, and the extent of such lengthening and shortening may be adjusted by adjustably positioning said second yarn guide.

16. The tufting machine as defined in claim 15 wherein said one end of said lever arm is rotatably mounted on said first pivot shaft.

17. The tufting machine as defined in claim 16 wherein said means for adjustably rotating said lever arm comprises a control shaft extending transversely across the machine and parallel to said first pivot shaft, means for manually rotating said control shaft, and linkage means interconnecting said control shaft and said lever arm, whereby rotation of said control shaft causes said lever arm and second yarn guide to pivot about the axis of said first pivot shaft.

18. The tufting machine as defined in claim 16 further comprising means for stripping the backing fabric from the needles during their reciprocation away from the fabric, said stripping means comprises a stripping bar, and means including a four-bar linkage for adjustably mounting said stripper bar adjacent said needle bar.

19. The tufting machine as defined in claim 18 wherein said four-bar linkage is operatively fixed to said first pivot shaft, whereby rotation of said first pivot shaft acts to raise or lower said stripping bar with respect to the backing fabric.

20. The tufting machine as defined in claim 16 wherein said tension controlling means further comprises a yarn feed roll extending transversely across the machine and adapted to have the yarns encircle the same, and means operatively connected to said power means for rotating said feed roll.

21. The tufting machine as defined in claim 20 wherein said tension controlling means further comprises a third yarn guide fixedly carried by said machine and extending generally parallel to said first and second yarn guides and adjacent said feed roll, a fourth yarn guide, means for mounting said fourth yarn guide to extend transversely across the machine and adjacent and parallel to said third yarn guide and for oscillatory movement with respect to said third yarn guide such that the yarn path of travel may be alternately lengthened and shortened, and means operatively connected to said power means for oscillating said fourth yarn guide in timed relation to the operation of said machine to maintain a substantially constant tension of the yarns about the feed roll.

22. The tufting machine as defined in claim 21 wherein said means for mounting said fourth yarn guide comprises a second pivot shaft extending transversely across the machine and parallel to said first pivot shaft, a transverse arm mounted to said second pivot shaft and having an end thereof mounting said fourth yarn guide, and means for oscillating said second pivot shaft to thereby oscillate the transverse arm and fourth yarn guide.

23. The tufting machine as defined in claim 22 wherein said means for oscillating said second pivot shaft comprises a third pivot shaft extending transversely across said machine and parallel to said second pivot shaft, means operatively connected to said power means for oscillating said third pivot shaft, and linkage means interconnecting said second pivot shaft and said third pivot shaft.

24. The tufting machine as defined in claim 23 wherein the linkage means interconnecting said second and third pivot shafts includes means for adjusting the length thereof, whereby the position of said fourth yarn guide may be adjusted.

* * * * *